US005160552A

United States Patent [19]

Tomita et al.

[11] Patent Number: 5,160,552

[45] Date of Patent: * Nov. 3, 1992

[54] COLORED ZINC COATING

[75] Inventors: Masatoshi Tomita; Susumu Yamamoto, both of Kurobe; Chikara Tominaga, Tokyo, all of Japan

[73] Assignee: Nippon Mining Co., Ltd., Tokyo, Japan

[ * ] Notice: The portion of the term of this patent subsequent to Jun. 11, 2008 has been disclaimed.

[21] Appl. No.: 694,749

[22] Filed: May 2, 1991

Related U.S. Application Data

[63] Continuation-in-part of Ser. No. 116,613, Nov. 3, 1987, Pat. No. 5,022,937.

[30] Foreign Application Priority Data

Nov. 21, 1986 [JP] Japan ..... 61-278175
Apr. 3, 1987 [JP] Japan ..... 62-81059
Apr. 3, 1987 [JP] Japan ..... 62-81063

[51] Int. Cl.[5] ..... C23C 8/00

[52] U.S. Cl. ..... 148/277; 148/281; 427/433

[58] Field of Search ..... 148/277, 281; 427/433

[56] References Cited

U.S. PATENT DOCUMENTS 3,630,792 12/1971 Smyth et al. ..... 427/433 X
3,778,315 12/1973 Booker et al. ..... 427/433 X
5,022,937 6/1991 Tomita et al. ..... 427/433 X

*Primary Examiner*—Michael Lusignan
*Attorney, Agent, or Firm*—Seidel, Gonda, Lavorgna & Monaco

[57] ABSTRACT

This invention permits, in a colored galvanized coating using Ti-Zn, Mn-Zn, Ti-Mn-Zn, (Ti, Mn)-(Cu, Ni, Cr)-Zn, etc., to clearly and stably develop yellow, purple, green, blue or other color by controlling the composition of a galvanizing bath and oxidizing conditions. Further, a gold, dark red, olive gray and iridescence color which have not yet obtained can be developed. The color development effected by this invention is clearer than conventional. Instead of galvanizing, the spraying process may be adopted. The surface painting on the colored zinc coating is effective.

24 Claims, No Drawings

COLORED ZINC COATING

CROSS REFERENCE INFORMATION

This is a continuation-in-part application of copending application Ser. No. 116,613, filed Nov. 3, 1987, now U.S. Pat. No. 5,022,937.

FIELD OF THE INVENTION

This invention relates to a colored zinc coating technique applied onto the surface of an iron or steel material, and particularly to a colored zinc coating method with the use of Ti-Zn, Mn-Zn, Ti-Mn-Zn, Mn-Cu-Zn or Ti-Cu-Zn system or other zinc alloys by which the development of new colors not obtained by conventional techniques and clearer color developments compared to conventional ones are permitted. According to this invention, the developments of gold, dark red, olive gray and iridescent colors which could not have yet obtained are permitted and simultaneously yellow color, green color, blue color, purple color, young grass color, etc. may be more clearly developed. Thus, this invention provides colored zinc coated materials which are applicable to wider variety of fields and have coloring more suitable to the environment where they are placed.

BACKGROUND OF THE INVENTION

Hot-dip galvanized iron and steel materials, coated by dipping in molten zinc, are used for corrosion protection purposes in a wide range of applications, forming parts and facilities in the fields: of building and construction, civil engineering, agriculture, fisheries, chemical plants, electric power supply and communications, and so forth.

For pylons and other towers, lighting poles, guard rails, temporary stands and frames for various operations and displays, shells and planks, and the like, there has been growing demand in recent years for colored hot-dip galvanized materials that present attractive appearances matching the environments involved, in preference to the classic hot-dip galvanized steels with metallic luster. With the spread of the aesthetic sense the colored hot-dip galvanized articles show promise, with extensive potential demand in architecture, civil engineering, industrial plants, electric power supply and communications, transportation, agriculture, marine products and other industries.

Coloration of hot-dip galvanized steels has usually been by the application of paints. The method has the disadvantage of the paint film eventually coming off the coated surface. This results from the activity of Zn in the coating of the hot-dip galvanized steel that causes gradual alkali decomposition of the fatty acid constituting the oily matter in the paint, leading to the formation of zinc soap that hampers the adhesion of the paint film to the underlying surface.

In an effort to eliminate the disadvantage, a complex procedure has had to be followed. An iron or steel article is first galvanized by dipping it into a molten zinc bath. The coated article is exposed to the air for one to three weeks so that corrosion products such as $Zn(OH)_2$, $ZnO$, $ZnCO_3$, $ZnCl_2$ and the like deposit on the coated steel surface. The surface is then cleaned and colored.

Aside from the coating method described above, another approach that depends on the color-developing action of the oxide film in the hot-dip galvanizing is known in the art. For example, Japanese Patent Application Publication No. 42007/1971 discloses a coloring treatment that uses a coating bath prepared by adding at lest one element selected from the group consisting of titanium, manganese, vanadium and the like to a hot-dip galvanizing bath. However, the hot-dip galvanized coatings obtained by the disclosed technique have been found to be generally very thin and light, with tendencies of rapid color fading and film separation with time. The desired color development is difficult to control precisely, often bringing out dim, indefinite hues.

For such reasons, even though many years have lapsed since its development, hot-dip galvanized coloring technique has not been put into practical use on a commercial scale.

Under such circumstances, there is a steady demand in the art for many improvements such as:

(a) The development of new colorings which have not yet obtained in the past;
(b) The development of colors which are more beautiful and clearer than ones previously obtained;
(c) The enhanced stability of color development;
(d) The development of a coloring system wherein the inherent corrosion resistance of galvanized zinc coating is not sacrificed;
(e) The development of a coloring system wherein there is a lesser degree of color change with the lapse of time; and
(f) The development of a coloring system which has an easy and stable operation.

OBJECT OF THE INVENTION

The object of this invention is to establish colored zinc coating technique by which the above-mentioned improvements may be attained using zinc alloys such as Ti-Zn, Ti-Mn-Zn, Mn-Zn, Ti-Cu-Zn, Mn-Cu-Zn or others.

Other objects, embodiments, advantages, features and deficits of this invention will become apparent to those skilled in the art from the following summary, detailed description, examples and appended claims.

SUMMARY OF THE INVENTION

Toward the above object, we have made many efforts. In the colored hot-dip galvanizing, the composition of the plating bath and the conditions of producing an oxidized film delicately combine to present coloring effects by light interference. By ingeniously controlling these factors, this invention succeeded in selectively developing yellow, purple, green or blue color in a clearer manner when compared to colors obtained heretofore in Ti-Zn, Ti-Cu-Zn, Ti-Ni-Zn and Ti-Cr-Zn systems. This invention also succeeds in more clearly developing various kinds of colorings in Ti-Mn-Zn and Mn-Cu-Zn systems. Further, in Ti-Zn alloys, we successfully attained the development of a golden color which had been thought that such was beyond the range of possibilities. Moreover, we have also succeeded in developing dark-red color which has been strongly desired. In addition, it became possible to attain the development of clearer yellow, purple, green or other colors compared to ones previously obtained. Further, in Ti-Mn-Zn alloys, we were successful in developing a strongly needed dark-red color, and in obtaining yellow, green and blue color clearer than previous ones. This invention is unique in the point that an olive-gray color strongly demanded may be developed using Mn-Zn and Mn-Cu-Zn alloys. In Mn-Zn and Mn-Cu alloys, an iridescent color, the development of which had never thought was successfully obtained. By using a Mn-Ti alloy with the impurity Pb content controlled, selective color development of purple and blue colors markedly clearer than one obtained heretofore, was successfully attained. Surprisingly, even golden color, which had never thought possible, could also be successfully developed by practicing the present invention.

This invention also found that a colored zinc coating may be applied by a spraying method.

The change of the colored zinc coating with the lapse of time may be suppressed by painting thereon.

DETAILED EXPLANATION OF THE INVENTION

Zinc alloy hot dipping is carried out by melting a zinc alloy in a coating bath and immersing a member to be coated therein.

A) Selective color development of clear yellow-purple-blue-green using Ti and/or Mn-Zn alloy or Ti and/or Mn-(Cu,Ni,Cr)-Zn alloy Using a galvanizing zinc alloy containing 0.3 to 0.7 wt % Ti or 0.1 to 0.5 wt % Mn or the both, yellow, purple, blue or green color may be clearly developed, depending upon the extent of oxidation, by hot dipping an iron or steel material in a bath at temperature of 480° to 530° C. followed by cooling under a specified condition selected from air cooling, water cooling etc. or by cooling after the hot dipped material was heated to a temperature atmosphere at 450° to 550° C.

The metallic zinc bullion to be used in forming the zinc alloy for hot dipping is typically one of the grades conforming to JIS H2107, for example, distilled zinc 1st grade (at least 98.5% pure), purest zinc (at least 99.99% pure), and special zinc grades. The impurities inevitably contained in these zinc materials are, for example in the distilled zinc 1st grade, all up to 1.2 wt Pb, 0.1 wt % Cd, and 0.020 wt % Fe. For the purposes of the invention a metallic zinc with a total impurity content of less than 1.5 wt % is desirable. In this embodiment, the hot dipping is carried out with the use of a molten zinc bath composed of the above-mentioned zinc bullion (chiefly, distilled zinc bullion is employed) with the addition of 0.3 to 0.7 wt % J Ti and/or 0.1 to 0.5 wt % Mn. Further, a molten zinc bath, further including at least one of 0.1 to 0.5 wt % Cu, 0.01 to 0.05 wt % Cr and 0.01 to 0.05 wt % Ni other than Ti and Mn, may be advantageously used.

In order to carry out galvanizing with the use of above-mentioned molten zinc bath, an iron or steel material is dipped in the bath of said zinc alloy at a bath temperature of 480° to 530° C. for 1 to 2 minutes and the coated material is drawn up from the bath and cooled in air followed by cooling with water.

Alternatively, after similarly dipping the iron or steel material into the bath and withdrawing it from the bath, it may be heated in an atmosphere at a temperature of 450°-550° C. for a short time period and then cooled in air followed by cooling with water.

When the coated material is allowed to cool in air, the oxidation time period is shortened to lessen the production of oxidized film. On the other hand, when the coating step is followed by heating, the oxidation time period is extended to make the resulting oxidized film heavier. Thus, the extent of oxidation in the resulting oxide film can be controlled by cooling and/or heating under varied conditions following the galvanizing procedure.

When an iron or steel material is dipped into a zinc alloy bath and then is allowed to stand in air, the material is formed at its surface with a plated layer or coating while forming oxidized film(s) thereon. In the case where the oxide film is allowed to stand for cooling for 5 to 10 seconds and then water cooled, the oxide film exhibits a yellow color hue.

In the case where the material is dipped into the zinc alloy bath, then heated and is followed air cooling and water cooling, the oxide film presents purple, blue or green color hue depending upon time period and temperature the material is subjected to during heating.

For example, when the iron or steel material is, after galvanizing, heated at an atmosphere at 450° C. for 50 to 60 seconds and then is air cooled and water cooled, a purple color is developed. On the other hand, when it is heated for two minutes and then air cooled and water cooled, a blue color is developed.

Thus, when the heating step is employed after the galvanizing step, a desired color such as purple, blue, green (young grass) or other colors may be selectively developed.

In addition, when Ti and Mn contents, as well as amounts of Cu, Cr and Ni, are added and/or varied within specified ranges as described before, the color hue and tone of the oxide film formed may be adjusted.

Explanations will now be provided as to how the contents of these metals in a zinc alloy used for galvanizing influence the formation of the oxide film and its color hue:

(a) Titanium (Ti)

When the Ti content in said galvanizing bath is less than 0.3 wt %, the formation of the oxide film on the galvanized layer becomes too slow. Therefore, even if the heating temperature and the time period are set at their upper limits, the color hue and tone of the oxide film become too light, resulting in a product having a low commercial value as a colored zinc coated product.

On the other hand, when the Ti content is higher than 0.7 wt %, the formation rate of the oxide film become too fast. Therefore, the change of the color hue of the oxide film produced is quick, thus making its color adjustment more difficult. In addition, the amount of oxides produced in the bath having this level of Ti is too great and the wetability of the oxide film to the galvanized material decreases.

(b) Manganese (Mn)

When the Mn content in said galvanizing bath is less than 0.1 wt %, the formation of the oxide film becomes too slow; thus resulting in a light-tone oxide film. On the other hand, when the Mn content is higher than 0.5 wt %, the adjustment of color hue becomes increasingly difficult and the wetability of the oxide film to the galvanized material becomes poor.

(c) Copper (Cu)

As described above, when Ti and Mn contents in the galvanizing bath are increased near to their upper limits the formation rate of the oxide film increases which makes it more difficult to hold the color hue constant. However, when the galvanizing bath contains Cu in the range of 0.1 to 0.5 wt %, the formation rate of the oxide film is suppressed. Accordingly the result the adjustment of the color hue and the wetability of the oxide film is improved. When the Cu concentration is outside of the above specified range, such effects cannot be expected.

(d) Chromium (Cr) and Nickel (Ni)

In a Ti-containing galvanizing bath (Ti-Zn alloy bath) and a Mn-containing bath (Mn-Zn alloy bath), Ti and Mn tend to distribute at a top layer of the bath. For this reason, the amount of oxides produced in the bath increases results in decreasing which the wetability of the oxide film to the galvanized material, in addition to lowering the yield of the bath. However, when Cr or Ni is present in a concentration range of 0.01 to 0.05 wt %, the Ti and Mn uniformly distributed throughout the bath. Therefore, the wetability of the oxide film to the galvanized material and the yield of the bath are improved. Outside the specified ranges of Cr and Ni, such effects are not obtainable.

In addition, when Cu, Cr or Ni is contained in the galvanizing bath of a molten zinc alloy, beside the aforementioned effects, interference colors inherent to these metals may be generated. This leads to an advantage that enhances clearness and brightness of the color hue of the oxide film produced.

(B-1) The development of golden color with Ti-Zn alloy

It is possible to form a colored coating with a golden hue on an iron or steel surface by plating the base metal using a bath of a zinc alloy for hot dipping of a composition comprising 0.1–0.5 wt % Ti—and the balance Zn at a bath temperature of 450°–470° C., allowing the plated work to stand in air for 5–20 seconds, and thereafter cooling it with cold or warm water.

With regard to the zinc used, the explanation in A) also applies here. Particularly, distilled zinc is preferred because it permits to effect plating with the use of ordinary flux and color strength produced becomes higher.

In this embodiment, the plating is carried out using a molten zinc alloy bath containing 0.1–0.5 wt % Ti—with the balance being Zn. This is obtained by adding 0.1–0.5 wt % Ti to the above-mentioned zinc. A bath of a molten zinc alloy containing 0.3 wt % Ti is particularly desirable.

In order to produce the golden colored coating from the hot-dip zinc alloy bath having the above composition, a base metal of iron or steel is immersed in the plating bath at 450°–470° C. for at least one minute, the base metal is pulled out of the bath and allowed to cool in air for about 5–20 seconds. The partially cooled material is then immediately quenched with cold or warm water to form thereon an oxide film with a golden hue.

Thus, in producing a golden colored coating, it is essential to immerse the iron or steel base metal in the bath of molten zinc alloy having the composition of 0.1–0.5 wt % Ti with the balance being Zn, while the bath is at a temperature of 450°–470° C. The material is then removed from the bath and allowed to cool in air for a very short period of about 5–20 seconds, preferably for 10–20 seconds. If the conditions are outside the ranges specified above, the desired golden hue will not result. For example, if the heating temperature is above 470° C., and if the period of time for which the plated materials are allowed to cool in air exceeds 20 seconds, the hue of the coating will turn purple.

As stated above, a colored coating with a uniform, stable golden hue can be formed on a base metal of iron or steel by plating it under specific conditions using a molten zinc alloy of the specific composition. It thus provides a corrosion-resistant material for the components and facilities for uses where they are required to be golden in color from an aesthetic viewpoint. The iron or steel products with colored coatings of the invention are highly corrosion-resistant and are of value in a wide range of commercial uses.

(B-2) The development of clear purple color with Ti-Zn alloy

It is possible to form a colored coating with a purple hue on an iron or steel surface by plating the base metal using a bath of a zinc alloy for hot dipping having a composition comprising 0.1–0.5 wt % Ti with the balance being Zn, while the bath is at a temperature of 500°–550° C. The purple color can be obtained by either (a) allowing the plated work to cool in air for 10–50 seconds or (b) by heating the plated work in an atmosphere at 500°–520° C. for 10–20 seconds, and thereafter cooling it with cold or warm water. With regard to a zinc bullion, the same explanation as in A) also applies here.

The plating is carried out using a molten zinc alloy bath of the composition comprising 0.1–0.5 wt % Ti with the balance being Zn. This alloy bath is obtained by adding 0.1–0.5 wt %, preferably 0.3 wt %, Ti to the abovementioned zinc.

In order to produce the purple colored coating from the hot-dip zinc alloy bath having the above composition, a base metal of iron or steel is immersed in the plating bath maintained at a temperature of 500°–550° C., preferably 500°–520° C., for at least one minute. The base metal is then removed from the bath and allowed to cool in air for about 10–50 seconds, preferably for 40–50 seconds. Thereafter, the partially cooled material is immediately quenched with cold or warm water to form thereon an oxide film with a purple hue. Alternatively, the work taken out of the bath can be heated in an atmosphere at a temperature of 500°–520° C. for 10–20 seconds and then cooled with cold or warm water to form a purple-colored oxide film thereon.

Thus, in producing a purple colored coating, it is essential to immerse the iron or steel base metal in the bath of molten zinc alloy having a composition comprising 0.1–0.5 wt % Ti with the balance being Zn, while the bath is at a temperature of 500°–550° C., preferably of 500°–520° C. Thereafter, the plated work is removed from the bath and is either (a) allowed to cool in air for a very short period of 10–50 seconds, preferably of 40–50 seconds or (b) heated in an atmosphere at a temperature of 500°–520° C. for 10–20 seconds, and then cooled with cold or warm water. If the conditions are outside the ranges specified above, the desired purple hue will not result.

As stated above, a colored coating with a uniform, stable purple hue can be formed on a base metal of iron or steel by plating it under specific conditions using a molten zinc alloy of the specific composition. It thus provides a corrosion resistant material for the components and facilities for uses where they are required to be purple in color from an aesthetic viewpoint.

The iron or steel products with colored coatings of the invention are highly corrosion-resistant and are of value in a wide range of commercial uses.

(B-2a) The development of clear purple color with Ti-Zn alloy

It has also been discovered that another possible method of forming a colored coating with a purple hue on an iron or steel surface comprises the steps of plating the base metal by hot-dipping it in a bath of a zinc alloy. The zinc alloy bath comprises 0.15 to less than 0.3 wt % Ti, with the balance being zinc. The alloy bath is maintained at a temperature of 470° to less than 550° C. After the base metal is dipped into the zinc alloy bath, it is withdrawn and heated to a temperature of 450° to 520° C. This is followed by a cooling step. When practicing the above procedure, the color of the coating on the base metal is that of a purple hue. With regard to the zinc bullion, the same explanation as in A) also applies here.

The plating is carried out by using a molten zinc alloy bath having the composition of 0.15 to less than 0.3 wt % Ti with the balance being zinc. This is obtained by adding 0.15 to less than 0.3 wt %, preferably 0.15–0.25 wt %, Ti, to the above-mentioned zinc.

In order to produce the purple color coating in accordance with this embodiment from the hot-dip zinc alloy bath of the above composition, a base metal of iron or steel is immersed in the plating bath at a temperature of 470° to less than 550° C., preferably at a temperature of 480°–530° C., for at least one minute. The base metal is then pulled out of the bath and heated in an atmosphere at a temperature of 450°–520° C., preferably 470°–510° C., for at least one minute, preferably between 1–2 minutes. Thereafter, the heated, coated material is cooled with cold or warm water to form a purple colored oxide film thereon.

As stated above, a colored coating with a uniform, stable purple hue can be formed on a base metal of iron or steel by plating it under specific conditions using a molten zinc alloy of a specific composition. If the conditions are outside of the aforementioned ranges, the desired purple color will not result. This embodiment of the invention provides a corrosion-resisted material for the components and facilities for uses where they are required to be purple in color from an aesthetic viewpoint. The iron or steel products colored by this process are highly corrosion-resistant and are of value in a wide range of commercial uses.

(B-3) Selective development of yellow, dark red, green color with Ti-Zn alloy

This invention also provides a zinc alloy for colored hot-dip galvanizing capable of developing yellow, dark red, and green colors selectively as desired. In order to achieve these colors, a bath of a zinc alloy for hot-dipping is employed wherein the bath is composed of 0.2–0.7 wt % Ti and the balance zinc and inevitable impurities.

It has further been found that the following alloys, made by adding the ingredients as follows to the above Ti-Zn alloy, are useful in uniform coloring in yellow, dark red, and green:

(a) A zinc alloy for colored hot-dip galvanizing capable of developing yellow, dark red, and green colors selectively as desired, composed of 0.2–0.7 wt % Ti, 1.3–5.9 wt % Pb, and the balance zinc and inevitable impurities.

(b) A zinc alloy for colored hot-dip galvanizing capable of developing yellow, dark red, and green colors selectively as desired, composed of 0.2–0.7 wt % Ti, 1.2–1.3 wt % Pb, 0.1–0.2 wt % Cd, and the balance zinc and inevitable impurities.

(c) A zinc alloy for colored hot-dip galvanizing capable of developing yellow, dark red, and green colors and desired, composed of 0.2–0.7 wt % Ti, 1.0–1.2 wt % Pb, 0.05–0.2 wt % Cd, 0.01–0.05 wt % of at least one element selected from the group consisting of Cu, Sn, Bi, Sb, and In, and the balance zinc and inevitable impurities.

A base material of iron or steel is galvanized by immersion into a molten zinc bath of such an alloy. The coated metal is withdrawn from the bath and (a) allowed to cool in the air or (b) heated at a specific temperature. Through proper control of the conditions, it is possible to bring out yellow, dark red, and green colors selectively at will. Even with an alloy based on a purest metallic zinc (at least 99.995% pure) or special zinc (at least 99.99% pure), galvanizing with good wetability and uniformity in hue can be achieved.

Zinc alloy hot dipping is carried out by melting a zinc alloy in a coating bath and immersing a work to be galvanized in the bath. The zinc alloy is prepared by adding a specific alloying additive to a metallic zinc. In the practice of the invention, a metallic zinc bullion with a high purity of at least 99.9%, typified by a purest zinc (99.995% pure) and special zinc (at least 99.99% pure) as defined in JIS H2107, is used. This prevents any adverse effects resulting from the variable introduction of impurities (Pb, Cd, Fe, etc.) such as decreasing the controllability of color development. Nevertheless, the use of such a high purity zinc brings shortcomings while it eliminates variations in the coating conditions due to the presence of impurities. For example, when an iron or steel material is galvanized by immersion in a coating bath (Fe saturated) containing predetermined amounts of Ti and Mn, the formation of an oxide film on the bath surface is rapid and large in amount. These and other factors tend to produce color shading, such as partial two-color mixing of the colored oxide film of the coating layer.

Under the circumstances the present inventors have found that the addition of 0.2–0.7 wt % Ti is effective in giving a yellow, dark red, or green color clearly and brightly without partial lackness of plating or unevenness in color.

If the Ti content in the coating bath is less than 0.2 wt %, the formation of a colored oxide film in the coating layer of the galvanized metal is inadequate, and the hue is low and nonuniform. This phenomena reduces the marketable value of the colored galvanized product. On the other hand, if the Ti content is above 0.7 wt %, the oxide film forms too rapidly. Therefore, the change in hue of the colored oxide film becomes too fast to control.

Moreover, too much oxide formation on the coating bath reduces t wetability of the bath with respect to the base metal to be galvanized.

For the further improvement in the coating wetability, various alloys, prepared by adding Pb, Cd, Sn, Bi, Sb, In, and/or the like to the Ti-Zn alloy, were investigated. As a result, the zinc alloys (a), (b), and (c) referred to above have now been found particularly useful. These three alloys will be described below.

(a) Alloy containing 1.3–5.9 wt % Pb in addition to Ti

If the Pb content is less than 1.3% the wetability-improving effect is limited. In colored coating at a bath temperature of 470°–500° C. partial uncoating will result. Especially in the bath temperature range of 470°-490° C. deposition on the coating film will frequently occur. In the 500°-600° C. range, color shading in the colored oxide film will result. The Pb addition proves increasingly effective up to the limit of its solubility. Since the Pb solubility in molten zinc at a bath temperature of 600° C. is 5.9 wt %, this value is taken as the upper concentration limit.

(b) Alloy containing 1.2-1.3 wt % Pb and 0.1-0.2 wt % Cd in addition to Ti

Where Pb and Cd are used together, small additions can prove effective. If the Pb content is less than 1.2 wt %, partial uncoating occurs in the colored coating at a bath temperature of 470°-600° C., even in the presence of Cd. In the temperature range of 470°-490° C. the possibility of dross deposition on the coating film will be greater. Even when the Pb content is within the specified range, similar troubles will take place if the Cd content is less than 0.1 wt %. If the Pb content exceeds 1.3 wt % or the Cd content is more than 0.2 wt %, the oxide formation on the coating bath becomes so much that the rate of uncoating rises.

(c) Alloy containing, besides Ti, 1.0-1.2 wt % Pb, 0.05-0.2 wt % Cd, and 0.01-0.05 wt % of at least one element selected from Cu, Sn, Bi, Sb, and In The addition of at least one element selected from the group consisting of Cu, Sn, Bi, Sb, and In promotes the wetability-improving effect of Pb and Cd. If the Pb content is less than 1.0 wt %, and if the Cd content is below 0.05 wt %, partial uncoating results from colored galvanizing at a bath temperature of 470°-600° C. Especially in the bath temperature range of 470°-490° C., the dross deposit on the coating film will increase. On the other hand, if the Pb content is more than 1.2 wt %, and if the Cd exceeds 0.2 wt %, a large degree of oxide formation on the coating bath surface is observed. The addition of 0.01-0.05 wt % of at least one of Cu, Sn, Bi, Sb, and In (a) retards the rate of oxide film formation on the bath surface and (b) improves the wetability for the work to be galvanized.

The addition elements set out above prevent uncoating, color shading, dross deposition, and other troubles, thus rendering it easy to control the hue of the colored oxide film, and increasing the color depth or strength.

In the hot dip galvanizing process with such a zinc alloy, the work to be galvanized is degreased, for example, by the use of an alkaline bath, descaled by pickling or the like, and then treated with a flux to be ready for galvanizing. The flux treatment is effected, for example, by a dip for a short time in a $ZnCl_2$—KF solution, $ZnCl_2$—$NH_4Cl$ solution, or other known flux solution.

After the pretreatment, the material to be galvanized is immersed into a coating bath at a specific controlled temperature for 1 to 3 minutes. The coated metal is pulled out of the bath and, through proper control of the degree of oxidation, a yellow, dark red, or green color is selectively obtained.

For instance, after the coated work has been pulled out of the bath, it is cooled under control by (a) natural cooling in the air, (b) cooling with cold or warm water, (c) slow cooling in an oven, or (d) by any other coating means known to those skilled in the art.

Alternatively, the coated metal from the bath can be held in an atmosphere at a temperature of 450°-550° C. for a predetermined period of time, so that the degree of its oxidation can be controlled. The holding temperature, holding time, and subsequent cooling method are chosen as desired.

As the degree of oxidation is increased, yellow, dark red, and green colors are developed successively in the order of mention.

An example of the oxidation degree control is as follows:

Yellow: After the work has been pulled out of the coating bath at a bath temperature of 590° C., it is held in atmosphere at 500° C. for 15-20 seconds and then is cooled with hot water.

Dark red: The bath temperature is increased by 5°-10° C., and either the atmosphere temperature is raised or the holding time is increased by 5-10 seconds.

Green: The bath temperature is made even higher by 5°-10° C., and either the atmosphere temperature is further increased or the holding time is extended by a further period of 5-10 seconds.

With the alloys of the invention, i.e., (a) the Ti—1.3-5.9 wt % Pb—bal. Zn alloy, (b) Ti—1.2-1.3 wt % Pb—0.1-0.2 wt % Cd—bal. Zn alloy, and (c) Ti—1.0-1.2 wt % Pb—0.05-0.2 wt % Cd—0.01-0.05 wt % (Cu, Sn, Bi, Sb, and/or In)—bal. Zn alloy, the color development is controllable in the order of golden, purple, and blue hues. In the order of increasing degrees of oxidation, gold, purple, blue, yellow, dark red, and green colors are brought out.

(B-4) The development of a yellow color with Ti-Zn alloy

It is possible to form a colored coating with a yellow hue on an iron or steel surface by plating the base metal using a zinc alloy for hot-dipping having a composition comprising 0.2-0.7 wt % Ti with the balance being Zn, while the bath is at a temperature of more than 530°-570° C. The yellow color can be obtained by either (a) allowing the plated work to cool in air for 10-50 seconds or (b) by heating the plated work in an atmosphere of 450°-550° C. and thereafter cooling it with cold or warm water. With regard to the zinc bullion, the same explanation as in A) also applies here.

The plating is carried out by using a molten zinc alloy bath of the composition comprising 0.2-0.7 wt % Ti with the balance being Zn. This alloy bath is obtained by adding 0.2-0.7 wt %, preferably 0.2-0.5 wt %, Ti to the above-mentioned zinc.

In order to produce the yellow color coating from the hot-dip zinc alloy bath having the above composition, a base metal of iron or steel is immersed in the plating bath maintained at a temperature of more than 530°-570° C., preferably 540°-560° C. for at least one minute. The base metal is then removed from the bath and allowed to cool in air for about 10-50 seconds, preferably for 40-50 seconds. Thereafter, the partially cooled material is immediately quenched with cold or warm water to form thereon an oxide film with a yellow hue. Alternatively, the work taken out of the bath can be heated in an atmosphere at a temperature of 450°-550° C., preferably 470°-510° C., for at least one minute, preferably 1-2 minutes; and then cooled to form a yellow-colored oxide film thereon.

Thus, in order to produce a colored coating with a uniform, stable yellow hue on a base metal of iron or steel in accordance with the above process, it is essential to have the base metal plated under the specific conditions using a molten zinc alloy of a specific composition. If the conditions are outside the aforementioned ranges, the desired yellow hue will not result. This embodiment of the invention provides a corrosion-resistant material for the components and facilities for uses where they are required to be yellow in color from an aesthetic viewpoint. The iron or steel products colored by this process are highly corrosion-resistant and are of value in a wide range of commercial uses.

(C-1) The development of dark-red color with Ti-Mn-Zn alloy

It is possible to form a colored coating with a dark red hue on a base metal of iron or steel by plating the base metal using a bath of a molten zinc alloy of a composition comprising 0.2–0.5 wt % Ti, 0.05–0.15 wt % Mn, and the balance Zn at a bath temperature of 580°–600° C., by heating the plated work in an atmosphere at a temperature of 500°–520° C. for 30–70 seconds, after it is withdrawn from the bath and thereafter cooling it with cold or hot water.

The metallic zinc to be used in forming the zinc alloy for hot dipping is typically one of the grades conforming to JIS H2107, for example, distilled zinc 1st grade (at least 98.5% pure), purest zinc (at least 99.99% pure), and special zinc grades. The impurities inevitably contained in these zinc materials are, for example, in the distilled zinc 1st grade, all up 1.2 wt % Pb, 0.1 wt % Cd, and 0.020 wt % Fe. For the purposes of the invention a metallic zinc with a total impurity content of less than 1.5 wt % is desirable. Among these zinc varieties, distilled zinc is preferred practically because it can be plated with ordinary flux and the concentration is high.

Under this embodiment the plating is carried out using a bath of molten zinc alloy made by adding 0.2–0.5 wt %, preferably 0.3 wt %, Ti and 0.05–0.15 wt %, preferably 0.1 wt %, Mn to the above-mentioned zinc.

In order to produce the dark red colored coating from the hot-dip zinc alloy bath of the above composition, a base metal of iron or steel is immersed in the plating bath at a temperature of 580°–600° C. for at least one minute. The base metal is pulled out of the bath and held in an atmosphere at a temperature of 500°–520° C. (for example in an oven) for 30–70 seconds. Then the coated material is immediately quenched with cold or warm water to form thereon an oxide film with a dark red hue.

Thus, in producing a colored coating with a specific dark red hue, it is important to (a) plate the iron or steel base metal using the bath of the molten zinc alloy of the specific composition at the specific bath temperature, (b) heat it under specific temperature conditions, and then (c) quench it with cold or hot water. If the conditions are outside the ranges specified above, no coating with the desired dark red hue be obtained.

(C-2) The development of green color with Ti-Mn-Zn alloy

Using a zinc alloy for hot dipping to form on a base surface a green colored coating containing 0.2–0.5 wt % Ti and 0.05–0.15 wt % Mn, it is possible to produce a green colored coating on an iron or steel surface by (a) coating the base metal with the zinc alloy useful for hot dipping which is maintained at a bath temperature of 600°–620° C., (b) removing the coated material from the bath and heating it in an atmosphere at a temperature of 500°–520° C. for 50–60 seconds, and (o) quenching it with cold or hot water or with a coolant gas.

The zinc to be used is in accordance with C-1).

The coating is carried out using a molten zinc alloy bath of the above-mentioned zinc with the addition of 0.2–0.5 wt % Ti and 0.05–0.15 wt % Mn. The use of a hot-dip bath of a zinc alloy containing 0.3 wt % Ti and 0.1 wt % Mn is particularly desirable for forming a green colored coating.

In order to produce the green colored coating from the hot-dip bath of the zinc alloy containing the above-specified percentages of Ti and Mn, a base metal of iron or steel is (a) immersed in the molten zinc alloy bath at 600°–620° C. for at least one minute, (b) pulled out of the bath and heated in an atmosphere (for example, in an oven) at a temperature of 500°–520° C. for 50–60 seconds and (c) quenched with cold or warm water or with coolant gas.

As described above, a colored coating with a uniform, stable green hue can be obtained by conducting the plating by the use of a hot-dip bath of molten zinc alloy containing 0.2–0.5 wt % Ti and 0.05–0.15 wt % Mn under the specified condition. If the Ti and Mn contents in the zinc alloy are outside the ranges specified, the green hue of the resulting colored coating will be uneven and the oxide film will show poor wetability with respect to the coated based metal.

Also if the bath temperature and subsequent heating temperature and time are not within the specific ranges, other hues can mix in, rendering it impossible to produce a coating having a uniform green hue.

Thus, when producing a green colored coating uniform in hue, important roles are played by the Ti and Mn contents in the molten zinc alloy for the hot-dip bath, the hot-dip conditions, and the subsequent heating conditions. It is only by the combination of such specific conditions that the objective green colored coating is obtained.

The colored coating formed resists corrosive attacks with the so-called corrosion weight loss by far the less than that of coatings using ordinary molten zinc alloys.

(C-3) The development of yellow color with Ti-Mn-Zn alloy

It is possible to form a colored coating with a yellow hue on an iron or steel surface by (a) plating the base metal with a zinc alloy for hot dipping containing 0.2–0.5 wt % Ti and 0.05–0.15 wt % Mn at a bath temperature of 580°–600° C., (b) heating the plated work in an atmosphere at a temperature 500°–520° C. for 20–30 seconds, and (c) quenching it with cold or warm water with coolant gas.

The zinc to be used is according to (C-1).

The plating is carried out using a molten zinc alloy bath of the above-mentioned zinc with the addition of 0.2–0.5 wt % Ti and 0.05–0.15 wt % Mn. A bath of a molten zinc alloy containing 0.3 wt % Ti and 0.1 wt % Mn is particularly desirable.

In order to produce the yellow colored coating from the hot-dip bath of the zinc alloy containing the above-specified amounts of Ti and Mn, a base metal of iron or steel is immersed in the plating bath at 580°–600° C. for at least one minute. The base metal is then pulled out of the bath and heated in an atmosphere (for example, in an oven) at a temperature of 500°–520° C. for 20–30 seconds. After the heating, the work is water-cooled for about 10 seconds to form thereon a colored coating of an oxide with a yellow hue.

Thus, in producing a yellow colored coating, it is especially important to perform the plating by the use of the bath of molten zinc alloy of the specific composition under the specific conditions and then heat the plated work in an atmosphere at a temperature of 500°-520° C. for 20-30 seconds. If the heating, after the plating process, is done under conditions outside the ranges specified above, no uniform yellow hue will be attained. For example, if the heating time exceeds 30 seconds the yellow color hue will be mixed with green, and the desired yellow colored coating will no longer be obtained. The colored coating obtained is excellent in its corrosion resistance.

(C-4) The development of blue color with Ti-Mn-Zn Alloy

It is possible to form a colored coating with a blue hue on an iron or steel surface by (a) plating the base metal using a bath of a zinc alloy for hot dipping of a composition comprising 0.1-0.5 wt % Ti, 0.05-0.15 wt % Mn, and the balance being Zn at a bath temperature of 530°-550° C., (b) withdrawing the plated material from the bath and allowing it to cool in air for 15-25 seconds, and (c) quenching it with cold or warm water.

The zinc to be used is in accordance with (C-1).

The plating is carried out using a bath of molten zinc alloy made by adding 0.1-0.5 wt %, preferably 0.3 wt %, Ti and 0.05-0.15 wt %, preferably 0.1 wt %, Mn to the above-mentioned zinc.

In order to produce the blue colored coating from the hot-dip zinc alloy bath of the above composition, a base metal of iron or steel is immersed in the plating bath at a temperature of 530°-550° C., for at least one minute. The base metal is pulled out of the bath and allowed to cool in air for about 15-25 seconds. The partially cooled material is then immediately quenched with cold or warm water to form thereon an oxide film with a blue hue.

Thus, in producing a blue colored coating, it is essential to plate the iron or steel base metal using the bath of molten zinc alloy of the composition comprising 0.1-0.5 wt % Ti, 0.05-0.15 wt % Mn, and the balance being Zn at a bath temperature of 530°-550° C., and then allow it to cool in air for a short period of 15-25 seconds. If the conditions are outside the ranges specified above, no coating with the desired blue hue will result.

The colored coating obtained in excellent is its corrosion resistance.

(D-1) The development of olive gray color with Mn-Zn alloy

Using a zinc alloy for hot dipping having a composition composed of 0.2-0.8 wt % Mn with the balance being Zn, it is possible to form an olive gray colored coating on a base metal of iron or steel by (a) plating the base metal using a bath of the above zinc alloy at a bath temperature of 490°-530° C., (b) removing the coated material from the bath and heating it in an atmosphere at a temperature of 500°-520° C. for 50-150 seconds, and (c) either cooling the heated coated material with warm water or first forcibly air-cooling and then cooling it with warm water.

The plating is carried out using a bath of molten zinc alloy made by adding 0.2-0.8 wt % Mn to a purest metallic zinc bullion (at least 99.995% pure) or special zinc bullion (at least 99.99% pure) conforming to JIS H2107 and used primarily as molten zinc alloy. The metallic zinc bullion for use in making the molten zinc alloy is desired to have a Pb content of 0.005 wt % or less.

In order to produce the olive gray colored coating from the hot-dip zinc alloy bath of the above composition, an iron or steel material is immersed in the plating bath at a temperature of 490°-530° C. for at least one minute. The base metal is pulled out of the bath and heated in an atmosphere at a temperature of 500°-520° C. for 50-150 seconds. Finally, the heated, coated material and then is either (a) cooled with hot water or (b) first air-cooled forcibly in air and then cooled with warm water.

Thus, in producing a colored coating with an olive gray hue by the use of the molten zinc alloy bath of a composition comprising 0.2-0.8 wt % Mn with the balance being Zn, it is important to heat the plated metal in an atmosphere at a temperature of 500°-520° C.

If the composition of the molten zinc alloy bath or the plating conditions deviate from the ranges specified above, the resulting colored coating can become uneven in hue or lose its hue, or the colored oxide film formed by the plating can tend to come off, rendering it impossible to obtain the desired olive gray colored coating.

As stated hereinbefore, a colored coating with a uniform olive gray hue can be formed on an iron or steel material by (a) plating it under the specific conditions using the molten zinc alloy bath of the specific composition, (b) heating the plated metal, and (c) cooling the heated, plated material. This process provides a corrosion-resistant material for the components and facilities for uses where they are required to be olive gray in color from an aesthetic viewpoint. Since the color-coated metal thus obtained is highly corrosion-resistant, the iron and steel products with such colored coatings according to the invention can be effectively used in a wide range of commercial applications.

(D-2) The development of olive gray color with Mn-Cu-Zn alloy

Using a zinc alloy for hot dipping to form on a base surface an olive gray colored coating of a composition comprising 0.2-0.8 wt % Mn, 0.05-1.10 wt % Cu, and with the balance being Zn, it is possible to form a colored coating with an olive gray hue on a base metal of iron or steel by (a) plating the base metal using a bath of a the above zinc alloy for hot dipping at a bath temperature of 490°-530° C., (b) heating the plated work in an atmosphere at a temperature of 500°-520° C. for 50-150 seconds, and (c) either cooling the heated, plated material with warm water or first forcibly subjecting it to air-cooling followed by cooling it with warm water.

The zinc to be used in making the molten zinc alloy is according to (D-1).

In order to produce the olive gray colored coating on an iron or steel material, the base metal is immersed in the plating bath of the molten zinc alloy of the above zinc containing 0.2-0.8 wt % Mn and 0.05-1.0 wt % Cu at a temperature of 490°-530° C. for at least one minute. The metal is pulled out of the bath and heated in an atmosphere at a temperature of 500°-520° C. for 50-150 seconds. The heated, plated material is then either (a) cooled with warm water or (b) first air-cooled forcibly in air and then cooled with warm water. In this way an olive gray colored coating of oxide film is formed on the iron or steel surface.

Thus, in producing a colored coating with an olive gray hue it is important to use the molten zinc alloy bath of the specific composition, and carry out the plating, heating, and other after treatments under the specific conditions set out above.

If the composition and the plating conditions deviate from the ranges specified above, the resulting colored coating can mix with some other hue or lose its hue, or the colored oxide film can tend to come off, rendering it impossible to obtain the desired olive gray hue.

The colored zinc coated steel obtained is excellent in its corrosion.

(D-3) The development of iridescent color with Mn-Zn or Mn-Cu-Zn alloy

Iridescent, multicolored coating which exhibits a blend of golden, purple, blue, and green colors was found in an epochal way of color development that is not mere coloration of the ordinary metallic-colored hot-dip galvanized articles, but which is a breakthrough in the traditional concept of hues with ordinarily colored galvanized products. This is achieved by using a zinc alloy comprising either 0.1–0.8 wt % Mn alone or 0.1–0.8 wt % Mn and 0.05–1.0 wt % Cu and the balance Zn and inevitable impurities. This process comprises hot-dipping a base metal of iron or steel into a bath at a temperature of 450°–550° C., and then cooling the galvanized metal with warm water.

The zinc alloy is made by adding a specific alloying additive or additives to metallic zinc bullion. The metallic zinc bullion to be used in making the molten zinc alloy under the invention is typically one of the grade conforming to JIS H2107, for example, distilled zinc 1st grade (at least 98.5% pure), purest zinc (at least 99.99% pure), and special zinc grades. The impurities inevitably contained in these zinc materials are, for example in the distilled zinc 1st grade, all up to 1.2 wt % Pb, 0.1 wt % Cd, and 0.020 wt % Fe. For the present invention a metallic zinc with a total impurity content below 1.5 wt % is desirable.

According to this invention, a molten zinc alloy bath of the above metallic zinc containing (1) 0.1–0.8 wt %, preferably 0.2–0.8 wt %, Mn or (2) 0.1–0.8 wt %, preferably 0.2–0.8 wt %, Mn and 0.05–1.0 wt % Cu is employed. If the Mn content in the coating bath is less than 0.1 wt %, the oxide film formation is too slow and the resulting hues are thin. On the other hand, if there is more than 0.8 wt % Mn present, this renders the hue adjustment difficult and reduces the wetability relative to the material being cooled. Moreover, an Mn content in excess of 0.2 wt % promotes the color development with a stable, blended multicolored effect. The addition of 0.05–1.0 wt % Cu makes it possible for the coating solution to uniformly and smoothly flow off to produce a coated film having a uniform thickness and is helpful in preventing the separation of the oxide film.

Hot dipping is effected by the use if the above molten zinc alloy bath is at a temperature of 45°–550° C. The immersion, time is about 1 to 3 minutes. After the immersion the coated work is cooled with warm water. The cooling is done by dipping the work in warm water at 40°–60° C. for 3–30 seconds. If the bath composition and treating conditions are outside the specified ranges, the desired iridescent color development will not be attained.

Experiments revealed that too thin sheets sometimes cannot be colored in blended iridescent hues, presumably due to high cooling rates. The workpieces to be galvanized are desired to be 1.6 mm or more in thickness.

Before being galvanized, the work is pretreated in the usual way. It is degreased, for example by the use of an alkaline bath, descaled by pickling or other treatment, and then fluxed by a quick dip in a flux solution such as $ZnCl_2$—KF solution or $ZnCl_2$—$NH_4Cl$ solution.

The simple procedure described above yields an iridescent multicolored coating which exhibits a blend of golden, purple, blue and green colors. The articles galvanized in this way are resistant to corrosive attacks and are capable of extensive use in the fields where both beautiful appearance and corrosion resistance are required.

(D-4) The development of gold-purple-blue color with Mn-Ti-Zn alloy

It has been discovered that, by maintaining a relative high Mn level and low Ti level with the restriction of the impurity lead level in Mn-Ti-containing zinc alloy, it is possible to develop colors in the series of golden-purple-blue hues with a substantial reduction of the holding time in the heating atmosphere following the galvanizing. Namely, these colors can be developed by using a hot-dip galvanizing zinc alloy containing 0.2–0.8 wt % Mn and 0.01–0.1 wt % Ti, with impurity Pb limited to 0.005 wt % or less. The galvanized surface is outstandingly smooth to the beauty of the appearance. Moreover, the bath temperature may be lower than usual.

The metallic zinc bullion to be used in making the zinc alloy of this embodiment must be such that its impurity Pb content is limited to 0.005 wt % or less. For this reason the use of the purest zinc bullion (at least 99.995% pure) defined in JIS H2107 is desirable. Special zinc bullion (at least 99.99 wt % pure) may also be used provided its Pb content is confined within the limited 0.005 wt % or below. If more than 0.005 wt % lead is present in the coating bath, the colors of the golden-purple-red series will not develop within short periods of time.

In accordance with the invention, 0.2–0.8 wt % Mn and 0.01–0.1 wt % Ti are added to the metallic zinc of high purity. These ranges of additions are based on the fact that a relatively small amount of Ti and a relatively large amount of Mn in the zinc alloy have been found helpful in shortening the period of time for which the galvanized work is held in the heating atmosphere. Thus, the upper limit of Ti is fixed to be 0.1 wt %. If the Ti content is less than 0.01 wt %, there is no beneficial effect of the Ti addition and coloring in desired hues becomes impossible. A large Mn content of 0.2 wt % or above is necessary to obtain desired hues rapidly, but if the content exceeds 0.8 wt % the adjustment of hues becomes difficult and the work is not adequately wetted with the bath.

In the hot-dip galvanizing with the zinc alloy, the work to be galvanized is degreased, for example by the use of an alkaline bath, descaled by pickling or the like, and then treated with a flux to be ready for galvanizing. The flux treatment is effected, for example, by a dip for a short time in a $ZnCl_2$—KF solution, $ZnCl_2$—$NH_4Cl$ solution, or other known flux solution.

After the pretreatment, the work is immersed in a coating bath at a specific controlled temperature for 1 to 3 minutes. The coated metal is pulled out of the bath and, through proper control of the degree of oxidation of the coating film, a golden, purple, or blue color is selectively obtained. As the degree of oxidation increases, golden, purple, and blue colors are brought out successively in the order of mention.

The galvanizing bath temperature is generally at a temperature of 480°-550° C., preferably 490°-520° C., or lower than the usual bath temperatures. This means a substantial reduction of energy cost in the case of mass treatment.

After the coated work has been taken out of the bath, its degree of oxidation is changed through control of the cooling rate by cooling the work in a variety of ways, including natural cooling in the air, cooling with cold or warm water, forcible cooling, and slow cooling in an oven. A desirable practice consists in holding the galvanized metal in an atmosphere at a temperature of 450°-550° C. for a predetermined period of time and changing the rate of subsequent cooling so as to control the degree of oxidation. If the alloy layer comes up to the surface no color will develop. Therefore, it is important to thicken the oxide film in preference to the growth of the alloy layer. The holding temperature, holding time, or cooling rate is so chosen as to cause appropriate color development. Under the invention the heating time can be shortened.

Thus, within shorter periods of time than in the past, colors of the golden-purple-blue series are brought out. The rapid color development combines with great smoothness of the coated surface to give a fine-looking colored hot-dip galvanized material.

This embodiment produces the following effect:

1. Because of the short heating time in the heating atmosphere, the process involving the zinc alloy of the invention is adapted for continuous hot-dip galvanizing lines.

2. The lower bath temperature and shorter heating time than heretofore permit reduction of energy cost and provide favorable conditions for quantity production.

3. The zinc alloy gives very smooth, fine-looking galvanized surfaces with bright hues in the golden-purple-blue series.

It was found to be effective to further include Ce in the alloys used in said A) to D).

(E) After-treatment

The colored oxide film formed on the colored, hot-dip galvanized material tends to discolor or fade with time, with changes in hue due to the progress of deterioration, depending on the environmental conditions including the sunlight, temperature, and humidity. Although the deterioration of the colored oxide film, of course, does not adversely affect the corrosion resistance of the hot-dip galvanized steel itself, the original beautiful appearance is unavoidably marred.

As a simple measure for protecting the colored oxide film on the colored hot-dip galvanized material to suppress the discoloring or fading with time. Surprisingly, painting has been found appropriate for realizing this object. As noted already, painting of the coated surface of ordinary (uncolored) hot-dip galvanized steel poses the problems of inadequate adhesion or separation of the paint film on short-period exposure. Partly responsible for these are the deposits on the galvanized steel surface of oxides (zinc white rust) and flux such as ammonium chloride used for the galvanizing. Presumably responsible too is the basic zinc dissolution product formed between zinc and the water that has permeated through the paint film. It is presumed that this product acts to decompose the resinous content (oily fatty acid) of an oily paint or long oil resin paint, causing the decomposition product to react with the zinc to produce zinc soap along the interface between the zinc surface and the paint film, thereby substantially reducing the adhesion of the paint.

A common belief has been that the colored oxide film layer formed on the surface of the colored hot-dip galvanized steel does not provide an adequate barrier between the zinc surface and the surrounding air. The pessimistic view that painting over the oxide film would, after all, be the same as direct paint application to the galvanized surface has been predominant. Contrary to these predictions, it has now been found that the colored oxide film has good affinity for and adhesion to paints, allowing the applied paint to permeate through the film to show high separation resistance, and is sufficiently capable of preventing water permeation to inhibit the reaction of the zinc layer with water and therefore the formation of zinc soap.

In accordance with the invention, the hot-dip galvanized materials thus colored may be coated with a paint having excellent adhesion, weather resistance, durability, and environmental barrier properties.

For the painting of ordinary hot-dip galvanized steels, pretreatment is essential and the types of paints that may be limited. With colored, hot-dip galvanized steels, by contrast, there is no need of pretreatment and various paints may be used. Since the heating for oxidation that follows the galvanized step produces a film of oxide such as $TiO_2$ or MnO on the galvanized surface, the coating on the galvanized steel is so clean that there is no necessity of treating the surface before painting.

The paint to be used may be any type which does not unfavorably affect, but protect, the colored oxide film layer to be painted. Typically a synthetic resin paint is used. Among synthetic resin paints, those superior in protective effects are polyurethane resin, acrylic resin, epoxy resin, and chlorinated rubber paints. The paint is properly chosen in consideration of the price, environments to be encountered, ease of application, and other factors.

Where the color of the colored oxide film is to be shown as it is, a clear paint is the best choice; and where the color tone is to be modified, an aqueous paint is the easiest to handle. In any case, the paint can be applied by brushing, spraying, or dipping.

In certain situations multicoating is not impractical. For instance, where the environments are very severe or adverse, multiple painting may be taken into account. An example is the application of an aqueous paint as the base coat and a clear paint as the intermediate and top coats. Alternatively, an epoxy resin paint, durable against the alkali attacks that result from zinc elution, may form the undercoat, and a chlorinated rubber or polyurethane paint, which is resistant to water, chemicals, and weather, may form the intermediate and surface coats.

Even if the paint degrades with time, leading to chipping or flaking of the coat, the beautiful appearance of the galvanized steel will remain unaffected thanks to the colored oxide film on the steel surface. Under the invention, such chipping or flaking seldom takes place because the paint permeated through and binds solidly with the colored oxide film. The paint that had permeated the oxide film keeps off water and the like by its water-repelling action and thereby protects the film.

(F) Spraying

For the colored hot-dip galvanizing, it is prerequisite that the work to be coated must be dipped in a molten zinc alloy bath. In practice, this sometimes meets with the following limitations:

(1) The dipping process is difficult to apply to shapes too large to be dipped in the bath.

(2) The coating of assembly parts and structures is sometimes difficult.

(3) Localized coloring is cumbersome. Although masking and other techniques may be resorted to, they involve much complexities and difficulties. The techniques are difficult to cope with the trend toward more frequent situations requiring pattern drawing for decorative purposes.

(4) For repairs of installations and the like the process is difficult to practice at sites.

(5) There are tendencies that the larger the content of such an alloying element as Ti and Mn, the worse the wetability of the bath and the more the number of holidays and other coating defects. Although an increase in the content of the additive element improves the durability of the resulting coating accordingly, such addition is sometimes difficult from the standpoint of the coating technology.

(6) The process sometimes brings failure of coating and other coating defects.

It has been discovered, however, that the colored zinc alloy coating can be applied by spraying. Specifically, the colored zinc coating by metal spraying basically involves spraying a zinc alloy, which is otherwise used for a coating bath, in the form of wire, rod, or powder, over the object. Surprisingly, the oxidation reaction of the additional element had been found to proceed more favorably than expected during the spraying process, achieving at least as satisfactory effects as the colored hot-dip galvanizing.

Thus, in the present invention, a colored zinc coating may be attained by spraying a coloring, oxidizing zinc alloy over a base surface by a metal spraying process, whereby a colored oxide film is formed on the base surface. After the spraying, the color development of the colored oxide film may be controlled by cooling and/or heating.

Metal spraying comprises heating a sprayable material to a half-molten state and spraying it over a base surface to form a coating tightly bonded to the surface. The sprayable material takes the form of a wire, rod, or powder, any of which may be employed under the invention.

The sprayable material may be any of the zinc alloys in common use for colored hot-dip galvanizing. It may, for example, be a Ti-Zn, Mn-Zn, or Ti-Mn-Zn alloy with or without the further addition of Cu, Ni and/or Cr. In the case of hot dipping, a work high in Ti, Mn or the like is not readily wetted when dipped in the bath, leaving flaws on the surface. The possibility of uncoating puts limitations to the amounts of the additive ingredients. Metal spraying is free from the wetability problem, and larger proportions of the additional elements can be used. Accordingly, the range of color development is wider and the hues have longer life. An example of desirable sprayable material is a zinc alloy containing 0.1–2.0 wt % Ti and optionally 0.01–4.0 wt % of at least one element selected from the group consisting of Mn, Cu, Cr, and Ni. With good workability the zinc alloy can be easily made into a wire or rod or powdered by crushing or melt dropping.

The sprayer that may usually be used is of the type known as a gas flame spray gun. An arc type spray gun may be employed as well.

The sprayable material is melted by the sprayer and sprayed over the base surface to be coated. The corners and intricate portions of the work difficult to coat by hot dipping can be completely coated by aiming the spray gun to those portions. Localized coatability permits figures and other patterns to be made easily. Another major advantage of metal spraying is the ability of coating iron and steel structures or the like at the sites.

After the spraying, the degree of surface oxidation is controlled so as to develop a desired color. A variety of colors, e.g., yellow, dark red, green, golden, purple, and blue colors, can be selectively developed as desired, depending on the degree of oxidation. For the oxidation control, the cooling rate of the sprayed coat can be adjusted by the use of natural cooling in the air or forced cooling with water or air. Also, the spray coat may be heated for a variable period with flame, infrared lamp, oven (where usable) or the like, and the subsequent cooling may be controlled. Proper combination of the sprayable material composition and surface oxidation conditions renders it possible to bring out a desired hue.

In this way a zinc sprayed coating with both corrosion resistance and colorability is produced.

The painting described above may be applied onto the sprayed coating.

The functional effects of the spraying are summarized as follows:

1. Applicable to large components that cannot be hot-dipped.
2. Capable of easily coating the portions of assembly parts and structures difficult to hot-dip.
3. Permits localized color development and display of a desired figure or other pattern thus enhancing the decorative value of the coating.
4. Possibility of coating at the site.
5. Ability to use high-melting alloys.
6. Ease of forming a thick coat suited for providing long-term corrosion protection.
7. A high Ti content in the alloy enhances the corrosion resistance and enriches the color hue.
8. The coating film, with a rough and porous surface, is suited as a base to be painted, and painting with a clear paint or various colored dyes can improve the durability of the colored oxide film of the coating.

Other than spraying process, vapor deposition process, sputtering process, ion plating process or other surface coating process may be applied in this invention.

In addition to the aforementioned features pertaining to obtaining colored galvanized coatings via a spraying process, it has been discovered that clearer colorings are obtained when the thermal spraying step is followed by a heating step. A specific example of this process will be set out later in this application.

The Examples will be described below: The Examples A to F correspond to the items A to F described in the detailed explanation.

EXAMPLE A

Test pieces of steel sheet, SS41, 50 mm wide, 100 mm long, and 3.2 mm thick, were degreased by immersion in an alkaline bath at 80° C. for 30 minutes. They were washed with hot water, and then derusted by immersion in a 10% hydrochloric acid bath at ordinary temperature for 30 minutes.

Next, the steel sheets were washed with warm water and fluxed by a dip in a solution containing $ZnCl_2$-$NH_4Cl$ for 30 seconds. The fluxing treatment is for removing the oxides on the surface of the steel sheet to promote the active surface of the sheet to a melt.

The steel sheets thus pretreated were plated by immersion in plating baths of the various compositions as shown in Table 1 at a temperature of 480°-500° C. for one to two minutes. They were pulled out of the bath at the rate of 3/m/min. Each set of steel sheets pulled out of the bath was subjected to the following cooling conditions to form oxide films thereon:

i) After the steel sheet were pulled out of the bath, it was allowed to cool in air followed by water cooling.
ii) After the steel sheet was pulled out of the bath, it was heated in an atmosphere at a temperature 500° C. for 10 to 30 seconds followed by air cooling and water cooling.
iii) After the steel sheet was pulled out of the bath, it was heated in an atmosphere at a temperature of 500° C. for 1.5 to 2.0 minutes followed by air cooling and water cooling.
iv) After the steel sheet was pulled out of the bath, it was heated in an atmosphere at a temperature 500° C. for 2.0 to 3.0 minutes followed by air cooling and water cooling.

As shown in Table 1, in the case where the steel sheets were dipped into the plating baths having various compositions and pulled out of the baths followed by being allowed to cool in air and water, oxide films having yellow hues were produced. On the other hand, when after the plating, heating step is adopted before air cooling and water cooling, purple, blue or young grass (light green) oxide films were produced according to the heating conditions.

As seen in No. 6 of Table 1, when Mn and Cu contents in the plating bath are near to their upper limits, it is known that bright color tones are developed.

TABLE 1

| No. | | Plating bath | Plating condition |
|---|---|---|---|
| 1 | 0.5% Ti—Zn | SHG: Virgin | 500° C. - 2 min - 3 m/min |
| | | SHG: Fe Saturate | 500° C. - 2 min - 3 m/min |
| | | PW: Fe Saturate | 480° C. - 1 min - 3 m/min |
| 2 | 0.5% Ti - 0.5% Cu—Zn | PW: Fe Saturate | 480° C. - 1.5 min - 3 m/min |
| 3 | 0.5% Ti - 0.5% Ni—Zn | PW: Fe Saturate | 500° C. - 1 min - 3 m/min |
| 4 | 0.5% Ti - 0.01% Cr—Zn | PW: Fe Saturate | 480° C. - 1.5 min - 3 m/min |
| 5 | 0.5% Ti - 0.0% Mn—Zn | PW: Fe Saturate | 500° C. - 1 min - 3 m/min |
| 6 | 0.5% Mn - 0.5% Cu—Zn | PW: Fe Saturate | 480° C. - 1 min - 3 m/min |

TABLE 1-continued

| No. | Formation of oxide film (color development) | Color |
|---|---|---|
| 1 | 1) Allowed to cool in air for 10 sec - water cooling | Yellow |
| | 2) 450° C. - 60 sec heating - air cooling - water cooling | Purple |
| | 3) 450° C. - 2 min heating - air cooling - water cooling | Blue |
| | 1) The same as above | The same as above |
| | 2) | |
| | 3) | |
| | 1) Allowed to cool in air for 5 sec - water cooling | The same as above |
| | 2) 450° C. - 50 sec heating - air cooling - water cooling | |
| | 3) 450° C. - 2 min heating - air cooling - water cooling | |
| 2 | 1) Allowed to cool in air for 10 sec - water cooling | The same as above |
| | 2) 500° C. - 1 min heating - air cooling - water cooling | |
| | 3) 500° C. - 2 min heating - air cooling - water cooling | |
| 3 | 1) Allowed to cool in air for 5 sec - water cooling | The same as above |
| | 2) 500° C. - 70 sec heating - air cooling - water cooling | |
| | 3) 500° C. - 110 sec heating - air cooling - water cooling | |
| 4 | 1) Allowed to cool in air for 5 sec - water cooling | The same as above |
| | 2) 500° C. - 1 min heating - air cooling - water cooling | |
| | 3) 500° C. - 2 min heating - air cooling - water cooling | |
| 5 | 1) Allowed to cool in air for 10 sec - water cooling | Dark blue |
| | 2) 500° C. - 30 sec heating - air cooling - water cooling | Blue |
| | 3) 500° C. - 1.5 min heating - air cooling - water cooling | Young grass |
| | 4) 500° C. - 2 min heating - air cooling - water cooling | Wall color |
| 6 | 1) Allowed to repidly cool in air - water cooling | Yellow |
| | 2) 500° C. - 10 sec heating - air cooling - water cooling | Red purple |
| | 3) 500° C. - 20 sec heating - air cooling - water cooling | Dark green |
| | 4) 500° C. - 30 sec heating - air cooling - water cooling | Light green |

Note)
"SHG: Virgin" indicates a plating bath based on 99.99% purity highest zinc.
"SHG: Fe Saturate" indicates a Fe-saturated plating bath based on 99.99% purity highest zinc.
"PW: Fe Saturate" indicates a Fe-Saturated plating bath based on not less than 98.5% purity distilled zinc.

EXAMPLE B-1

Development of Golden Color With Ti-Zn Alloy

A test piece of steel sheet, SS41, 50 mm wide, 100 mm long, and 3.2 mm thick, was degreased by immersion in an alkaline bath at 80° C. for 30 minutes. It was washed with hot water, and then derusted by immersion in a 10% hydrochloric acid bath at ordinary temperature for 30 minutes.

Next, the steel sheet was washed with hot water and was fluxed by a dip in a solution containing 35% $ZnCl_2$-$NH_4Cl$ at 60° C. for 30 seconds.

The steel sheet thus pretreated was plated by immersion in a plating bath of the composition comprising 0.3 wt % Ti, with the balance being Zn, when at a temperature of 450°-470° C. for one minute. It was pulled out of the bath, allowed to cool in air for 10-20 seconds, and immediately cooled with water at ordinary temperature. The steel surface so obtained had a coating of oxide with a lustrous, uniform golden hue.

The test piece of steel sheet with color coating thus obtained was subjected to a salt spray corrosion test for 240 hours. The corrosion weight loss was 72 g/m$^2$.

By way of comparison, ordinary plated steel sheets hot-dip galvanized with distilled zinc were likewise tested. The corrosion weight loss amounted to as much as 120-150 g/m$^2$.

EXAMPLE B-2

Development of Purple Color With Ti-Zn Alloy

The steel sheet, pretreated in the same manner as the previous example, was plated by immersion in a plating bath of the composition comprising 0.3 wt % Ti, with the balance being Zn, when at a temperature of 500°-520° C. for one minute. It was pulled out of the bath, allowed to cool in air for 40-50 seconds, and immediately cooled with water at ordinary temperature.

The steel surface so obtained had a coating of oxide with a uniform purple hue.

The test piece of steel sheet with color coating thus obtained was subjected to a salt spray corrosion test for 240 hours. The corrosion weight loss ws 63 g/m$^2$.

By way of comparison, ordinary plated steel sheets hot-dip galvanized with distilled zinc were likewise tested. The corrosion weight loss amounted to as much as 120-150 g/m$^2$.

EXAMPLE B-2a

Development of Purple Color

The steel sheet, pre-treated in the same manner as the previous example was plated by immersion in a plating bath for 90 seconds. The plating bath had a composition comprising 0.2 wt. % Ti, with the balance being zinc. The bath was maintained when at a temperature of 480° C. The coated material was pulled out of the bath and conveyed to a heating furnace in 17 seconds. There, the coated sheet was heated in air at a temperature of 500° for 90 seconds. When the coated sheet was withdrawn from the furnace, a uniform purple color had been developed. The heated, colored material was let to cool.

EXAMPLE B-3

Development of Yellow - Dark Red - Green Color and Additional Development of Gold - Purple - Blue Color The individual pieces pretreated as described previously were immersed in coating baths of the compositions given in Table 2 for one minute and then were pulled out at a rate of about 6 meters per minute. The steel pieces thus taken out of the baths were heated in an atmosphere at a temperature of 500° C. for given periods of time, and cooled with hot water to form the following colored oxide films.

The treating conditions were as follows:

| | |
|---|---|
| Yellow: | Bath temperature 590° C. |
| | ↓ |
| | Holding at 500° C. for 15-20 seconds |
| Dark red: | Bath temperature 600° C. |
| | ↓ |
| | Holding at 500° C. for 25-30 seconds |
| Green: | Bath temperature 610° C. |
| | ↓ |
| | Holding at 500° C. for 35-40 seconds |

TABLE 2

| | Alloy No. | Zinc alloy ingredient (wt %) Ti | Pb | Cd | Cu, Sn, Bi, Sb, In | Holiday | Color shading | Dross deposition | Rating |
|---|---|---|---|---|---|---|---|---|---|
| This invention | 1 | 0.25 | — | — | — | ○ | ○ | ○ | Acceptable |
| | 2 | 0.25 | 1.5 | — | — | ○ | ○ | ○ | Good |
| | 3 | 0.50 | 1.2 | 0.1 | — | ○ | ○ | ○ | Good |
| | 4 | 0.30 | 1.2 | 0.1 | Cu 0.01 | ○ | ○ | ○ | Very good |
| | 5 | 0.45 | 1.1 | 0.1 | Cu 0.02 In 0.05 Sn 0.04 | ○ | ○ | ○ | Very good |
| Comparative Example | 6 | 0.17 | 1.3 | | | ○ | x | ○ | Unacceptable |
| | 7 | 0.35 | 1.1 | 0.05 | | x | x | x | Unacceptable |

○ No
x Yes

Using alloys Nos. 2 to 5 of this Example, golden, purple, and blue colors were successfully developed under the following conditions:

| | |
|---|---|
| Golden: | Bath temperature 490° C. (1 min) |
| | ↓ |
| | Holding at 500° C. for 1-2 seconds |
| Purple: | Bath temperature 500° C. (1 min) |
| | ↓ |
| | Holding at 500° C. for 10-15 seconds |
| Blue: | Bath temperature 520° C. (1 min) |
| | ↓ |
| | Holding at 500° C. for 15-20 seconds |

Thus, in the same manner as in the earlier Examples, the oxidation conditions were gradually intensified to provide a wide variety of colors, as many as six, i.e., golden - purple - blue - yellow - dark red - green, in succession in a controllable manner. No flaws or color shading were observed.

EXAMPLE B-4

Development of Yellow Color With Ti-Zn Alloy

Four steel grating members, each having a weight of 20 kg, were pre-treated in the same manner as the previous example. These grating members were plated by immersing them in a hot dipping bath of a zinc alloy for 90 seconds. This dipping bath contained 0.25 wt. % Ti, with the balance being zinc and was maintained at a temperature of 550° C. The coated members were then withdrawn from the bath and conveyed to a heating furnace in 17 seconds. There, the coated members were heated at a temperature of 500° C. for 90 seconds. Upon withdrawing the heated members from the heating furnace, they all had a uniform yellow colored coating. These members were then conveyed to a water tank in 16 seconds and cooled with water until their temperature fell below 100° C.

EXAMPLE C-1

Development of Dark Red Color With Ti-Mn-Zn Alloy

A test piece of steel sheet, SS41, 50 mm wide, 100 mm long, and 3.2 mm thick, was degreased by immersion in an alkaline bath at a temperature of 80° C. for 30 minutes. It was washed with hot water, and then derusted by immersion in a 10% hydrochloric acid bath at ordinary temperature for 30 minutes. Next, the steel sheet was washed with hot water and was fluxed by a dip in a solution containing 35% $ZnCl_2$-$NH_4Cl$ at a temperature of 60° C. for 30 seconds.

The steel sheet thus pretreated was plated by immersion in a plating bath of the composition comprising 0.3 wt % Ti, 0.1 wt % Mn, and with the balance being Zn while at a temperature of 580°-600° C. for one minute. It was pulled out of the bath, held in an oven at a temperature 500°-520° C. for 30-70 seconds, taken out of the oven, and was immediately cooled with warm water at a temperature of 40°-60° C.

The steel surface so obtained had a coating of oxide film with a dark red hue.

The test piece of steel sheet with color coating thus obtained was subjected to a salt spray corrosion test for 240 hours. The corrosion weight loss was 60 g/m$^2$.

By way of comparison, ordinary plated steel sheets hot-dip galvanized with distilled zinc were likewise tested. The corrosion weight loss amounted to as much as 120°-150 g/m$^2$.

EXAMPLE C-2

Development of Green Color With Ti-Mn-Zn Alloy

The steel sheet thus pretreated as described was plated by immersion in a plating bath of the composition given below at a temperature of 600°-620° C. for one minute. It was pulled out of the bath, held in an oven at a temperature of 500°-520° C. for 50-60 seconds, taken out of the oven, and cooled with warm water by a dip in the bath for 10 seconds.

Composition of the bath was as follows:

0.3 wt % Ti, 0.1 wt % Mn, and the balance Zn.

The zinc used was distilled zinc 1st grade.

The sequential steps of plating, heating, and cooling with warm water gave a uniformly colored coating layer with a bright green hue.

The test piece of steel sheet with color coating thus obtained was subjected to a salt spray corrosion test for 240 hours. The corrosion weight loss ws 61 g/m$^2$.

By way of comparison, ordinary steel sheets hot-dip galvanized with distilled zinc were likewise tested. The corrosion weight loss amounted to as much as 120-150 g/m$^2$.

EXAMPLE C-3

Development of Yellow Color With Ti-Mn-Zn Alloy

The steel sheet pretreated as previously described was plated by immersion in a plating bath of the composition comprising 0.3 wt % Ti, 0.1 wt % Mn, and the balance being Zn, while at a temperature of 580°-600° C. for one minute. It was pulled out of the bath, held in an oven at a temperature of 500°-520° C. for 20-30 seconds, taken out of the oven, and immediately cooled by dipping in warm water at a temperature of 40°-60° C. for 10 seconds.

The steel surface so obtained had a coating of oxide with a bright yellow hue.

The test piece of steel sheet with color coating thus obtained was subjected to a salt spray corrosion test for 240 hours. The corrosion weight loss ws 48 g/m$^2$.

By way of comparison, ordinary steel sheets hot-dip galvanized with distilled zinc were likewise tested. The corrosion weight loss amounted to as much as 120-150 g/m$^2$.

EXAMPLE C-4

Development of Blue Color With Ti-Mn-Zn Alloy

The steel sheet pretreated as previously described was plated by immersion in a plating bath of the composition comprising 0.3 wt % Ti, 0.1 wt % Mn, and with the balance being zinc, while at a temperature of 530°-550° C. for one minute. It was pulled out of the bath, allowed to cool in air for 15-25 seconds, and immediately cooled with water at ordinary temperature.

The steel surface so obtained had a coating of oxide film with a uniform blue hue.

The test piece of steel sheet with color coating thus obtained was subjected to a salt spray corrosion test for 240 hours. The corrosion weight loss ws 70 g/m$^2$.

By way of comparison, ordinary plated steel sheets hot-dip galvanized with distilled zinc were likewise tested. The corrosion weight loss amounted to as much as 120-150 g/m$^2$.

EXAMPLE D-1

Development of Olive-Gray Color With Mn-Zn Alloy

A test piece of steel sheet, SS41, 50 mm wide, 100 mm long, and 3.2 mm thick, was degreased by immersion in an alkaline bath at a temperature of 80° C. for 30 minutes. It was washed with hot water, and then descaled by immersion in a 10% hydrochloric acid bath at ordinary temperature for 30 minutes. Next, the steel sheet was washed with hot water and was fluxed by a dip in solution containing 35% $ZnCl_2$-$NH_4Cl$ at a temperature of 60° C. for one minute.

The steel sheet thus pretreated was plated by the use of a plating bath of the following composition under the following conditions:

| Plating Bath Composition | | |
|---|---|---|
| Element | | (wt. %) |
| Mn | | 0.3-0.5 |
| Zn (Pb content = 50 ppm or less) | | bal. |
| **Plating Conditions** | | |
| Bath temp. (°C.) | Heating temp. (°C.) | Heating time (sec) |
| 500 | 500 | 150 |

The plated steel sheet surface had a colored coating with a uniform olive gray hue.

EXAMPLE D-2

Development of Olive Gray Color With Mn-Cu-Zn Alloy

The steel sheet pretreated as previously described was plated by immersion in a plating bath of the following composition at a temperature of 490°-530° C. for one minute. The sheet was then pulled out of the bath and held in an oven at a temperature 500°-520° C. for 50-150 seconds. The plated sheet taken out of the oven was either cooled with warm water or forcibly air-cooled in air and then cooled with warm water.

| Plating Bath Composition | |
|---|---|
| Element | (wt. %) |
| Mn | 0.3-0.5 |
| Cu | 0.1 |
| Zn (Pb content = 50 ppm or less) | bal. |

-continued

| Bath temp. (°C.) | Plating conditions Heating temp. (°C.) | Heating time (sec) |
|---|---|---|
| 520 | 500 | 100 |
| 500 | 500 | 150 |

The plated steel sheet surface had a colored coating with a uniform olive gray hue.

EXAMPLE D-3

Development of Iridescent Color With Mn-Zn or Mn-Cu-Zn Alloy

Test pieces of steel sheets, grade SS41, measuring 50 mm wide, 100 mm long, and 1.6–6.0 mm thick, were degreased by immersion in an alkaline bath at a temperature of 80° C. for 30 minutes. They were washed with hot water, and then were descaled by immersion in a 10% hydrochloric acid solution at ordinary temperature for 30 minutes. Next, the steel pieces were washed with hot water fluxed by immersion in a 35% $ZnCl_2$-$NH_4Cl$ solution at a temperature of 60° C. for one minute. The steel pieces so pretreated were galvanized by immersion in the baths of compositions shown in Table 3 at a temperature of 450°–550° C. for one minute, and then cooled with warm water. The cooling was done by a dip in a bath of warm water at a temperature of 40° C. for 5 seconds. The results are shown in Table 3.

TABLE 3

| zinc alloy (wt %) | Galvanizing condition Bath temp. | Dip time | Cooling | Hue | Oxide film separation[1] | Driplessness[2] |
|---|---|---|---|---|---|---|
| 0.2% Mn—Zn | 460° C. | 1 min | warm water cooling | iridescent colored | ○ | x |
| 0.35% Mn—Zn | 450 | " | warm water cooling | iridescent colored | ○ | x |
| 0.5% Mn—Zn | 555 | " | warm water cooling | iridescent colored | x | ○ |
| 0.6% Mn—0.08% Cu—Zn | 480 | " | warm water cooling | iridescent colored | ○ | ○ |
| 0.5% Mn—0.2% Cu—Zn | 500 | " | warm water cooling | iridescent colored | ○ | ○ |

[1]Oxide film separation: ○ No x Yes
[2]Driplessness: ○ Good x Poor

EXAMPLE D-4

Development of Gold - Purple - Blue With Mn-Ti-Zn Alloy

The steel pieces treated as described in D-1 were immersed in a bath of molten zinc alloy containing 0.5 wt % Mn and 0.08 wt % Ti, with the Pb content restricted to 0.004 wt %, at a temperature of 500° C. for one minute. They were then held in a heating atmosphere at a temperature of 500° C. and cooled. The relations between the treating conditions and coloring are shown in the following Table 4. Golden and purple colors came out very rapidly and even blue color developed in 30 seconds. The galvanized surfaces were quite smooth and beautiful in appearance.

TABLE 4

| Color development | Bath temp. (°C.) | Heating temp. (°C.) | Heating time (sec) | Cooling time (sec) | Smoothness and beautifulness |
|---|---|---|---|---|---|
| Golden | 500 | 500 | 2 | 6 | Good |
| Purple | 500 | 500 | 7 | 10 | " |
| Blue | 500 | 500 | 30 | 50 (allowed to cool) | " |

EXAMPLE E

After Treatment

Test pieces of steel sheet, measuring 50 mm wide, 100 mm long, and 3.2 mm thick, were either conventionally hot-dip galvanized or colored, hot-dip galvanized (with a Zn-Ti alloy). The galvanized pieces were coated with a clear polyurethane resin (resin : hardener=5:1) or a colored, aqueous acrylic resin paint by brushing or dipping. The coated pieces, together with uncoated ones, were subjected to outdoor weathering tests. The tests were conducted within a plant under the possession of the present applicant. The degrees of degradation after test periods of three months, six months, and one year were visually inspected. The results are tabulated below in Table 5.

Conventionally hot-dip galvanized pieces became defective in only three months after the painting. Among the colored, hot-dip galvanized pieces, the golden-colored piece had a thinner oxide film than the rest because of the incomplete oxidation. Without a paint coat, therefore, the golden-colored piece degraded in three months and the blue-colored in one year. Painting could retard the degradation. Needless to say, an increase in the thickness of the paint coat, multicoating, or other similar step would prove effective in further retarding the degradation.

With regard to Ti-Mn-Zn system, Mn-Zn system etc., good effects with the painting were confirmed.

TABLE 5

| | Test piece condition | | Outdoor weathering test 3 months | 6 months | 1 year |
|---|---|---|---|---|---|
| Aqueous acrylic resin | Hot-dip galvanized | | x | x | x |
| | Colored galvanized | Blue | ○ | ○ | ○ |
| | | Yellow | ○ | ○ | ○ |
| | | Green | ○ | ○ | ○ |
| Clear polyurethane resin | Colored galvanized | Golden | ○ | Δ | x |
| | | Blue | ○ | ○ | ○ |
| | | Yellow | ○ | ○ | ○ |
| | | Green | ○ | ○ | ○ |
| | | Olive | ○ | ○ | ○ |
| Not painted | Colored galvanized | Golden | x | x | x |
| | | Blue | ○ | ○ | Δ |
| | | Yellow | ○ | ○ | ○ |
| | | Green | ○ | ○ | ○ |
| | | Olive | ○ | ○ | ○ |

○: Good
Δ: Rather poor
x: Poor

EXAMPLE F-1

Spraying

A rod of zinc alloy containing 1.9 wt % Ti and 0.3 wt % Mn was used as a sprayable material. It was sprayed over a steel material by means of an oxy-acetylene gas flame type spray gun. The sprayed surface was allowed to cool, heated to a temperature of 500° C. for 30 seconds, and again allowed to cool in the air. A green colored coating was obtained.

EXAMPLE F-2

Spraying

Under the same conditions as in Example F-1 but by the use of a zinc alloy rod containing 1.0 wt % Ti, spraying and after heat treatment were carried out. A blue colored coating resulted.

EXAMPLE F-3

Spraying

A rod of zinc alloy containing 0.3 wt % Mn was used as a sprayable material. It was sprayed over a steel material by means of an oxy-acetylene gas flame type spray gun. The sprayed surface was allowed to cool, heated to a temperature of 500° C. for 30 seconds, and again allowed to cool in the air. A olive gray colored coating was obtained.

EXAMPLE F-4

Spraying

A zinc alloy containing 0.2 wt. % Ti, with the balance being zinc was formed into rods having a diameter of 1.6 mm. These rods were to be used for thermal spraying in accordance with the present invention.

The thermal spraying was carried out using a spray gun with nitrogen gas as the carrier gas. The spraying rods were heated to a high temperature to form melts within the gun. The melts were entrained by the nitrogen carrier gas towards the metal substrate and deposited thereon. An iron plate, an aluminum plate and a refractory member were employed as the substrates.

After spraying it was observed that the color of the thermally sprayed surface was not adequately clear and uniform. Thereafter, the thermally sprayed surfaces were heated to 425° C. and 450° C. for varied time periods. As the result, gold, purple and blue colors were obtained. The specific color obtained depended upon the heating time periods, such as is listed in the following Table:

TABLE

| Heated Temperature Color | Heated Time Period | Developed |
|---|---|---|
| 425° C. | 10 min | gold |
| | 13 min. | purple |
| | 15 min. | blue |
| 450° C. | 8 min. | gold |
| | 12 min. | purple |
| | 14 min. | blue |

It is evident from the foregoing that various modifications can be made to the embodiments of this invention without departing from the spirit and scope thereof which will be apparent to those skilled in the art. Having thus described the invention, it is claimed as follows:

That which is claimed:

1. A method of forming a colorized zinc coating on an iron or steel surface characterized in that using a galvanizing zinc alloy comprising 0.15 to less than 0.3 wt. % Ti, said iron or steel surface coated on a hot dipping bath of said alloy at a temperature of 470° to less than 550° C. and the coated surface obtained is heated to a temperature of 450° to 520° C. followed by cooling whereby a coating having a purple color is formed.

2. A method as recited in claim 1 wherein the zinc alloy contains 0.15 to 0.25 wt. % titanium.

3. A method as recited in claim 1 wherein the temperature of the hot dipping bath is maintained within the range to 480° to 530° C.

4. A method as recited in claim 1 wherein, after being dipped, the coated surface is heated to a temperature of 470°-510° C.

5. A method as recited in claim 4 wherein the zinc alloy contains 0.15 to 0.25 wt % titanium, and wherein the temperature of the dipping bath is maintained within the range of 480° to 530° C.

6. A method as recited in claim 5 wherein, after being dipped, the coated surface is heated to a temperature of 500° C., wherein the zinc alloy contains 0.2 wt % titanium, and wherein the dipping bath is maintained at a temperature of 480° C.

7. A method of forming a colored zinc coating on an iron or steel surface characterized in that it is employs a galvanizing zinc alloy comprising 0.2 to 0.7 wt. titanium, said iron or steel surface being coated in a hot dipping bath of said zinc alloy maintained at a temperature of greater than 530°-570° C. and the coated surface obtained is immediately cooled or is cooled after being heated to a temperature of 450° to 550° C. whereby a coating having a yellow color is formed.

8. A method as recited in claim 7 wherein the zinc alloy contains 0.2-0.5 wt. % titanium.

9. A method as recited in claim 7 wherein the temperature of the hot dipping bath is maintained within the range of 540° to 560° C.

10. A method as recited in claim 9 wherein, after being dipped, the coated surface is heated to a temperature of 470° to 510° C.

11. A method as recited in claim 10 wherein the zinc alloy contains 0.2 to 0.5 wt % titanium, and wherein the temperature of the hot dipping bath is maintained within the range of 540°-560° C.

12. A method as recited in claim 11 wherein, after being dipped, the coated surface is heated to a temperature of 500° C., wherein the zinc alloy contains 0.25 wt % of titanium, and wherein the hot dipping bath is maintained at a temperature of 550° C.

13. A method of forming a colored zinc coating on a substrate comprising the steps of:

a. preparing a coloring zinc alloy containing 0.1 to 2.0 wt. % titanium;

b. heating said zinc alloy to a temperature at which the alloy is in the form of a melt;

c. thermally spraying said zinc alloy in the form of a melt onto the surface of a metal substrate; and d. heating said thermally sprayed surface to a temperature of 380° to 450° C., whereby a clear colored surface is formed.

14. A method as recited in claim 13 wherein said zinc alloy further comprises 0.01 to 4.0 wt. % of at least one of the components selected from the group consisting of Mn, Cu, Cr, and Ni.

15. A method as recited in claim 13 wherein, by manipulating the heating temperature and time of step (d), the colored surface can take a gold, purple or blue hue.

16. A method as recited in claim 1 wherein the colored zinc coating is coated with a paint.

17. A method as recited in claim 16 wherein the paint is selected from the group consisting of synthetic resin paints.

18. A method as recited in claim 17 wherein said synthetic resin paint is selected from the group consisting of polyurethane resin, acrylic resin, epoxy resin and chlorinated rubber paints.

19. A method as recited in claim 7 wherein the colored zinc coating is coated with a paint.

20. A method as recited in claim 19 wherein the paint is selected from the group consisting of synthetic resin paints.

21. A method as recited in claim 20 wherein said synthetic resin paint is selected from the group consisting of polyurethane resin, acrylic resin, epoxy resin and chlorinated rubber paints.

22. A method as recited in claim 13 wherein the colored zinc coating is coated with a paint.

23. A method as recited in claim 22 wherein the paint is selected from the group consisting of synthetic resin paints.

24. A method as recited in claim 23 wherein said synthetic resin paint is selected from the group consisting of polyurethane resin, acrylic resin, epoxy resin and chlorinated rubber paints.

* * * * *